United States Patent [19]

Price

[11] Patent Number: 5,024,291

[45] Date of Patent: Jun. 18, 1991

[54] LADDER ASSEMBLY

[76] Inventor: Thomas W. Price, 30524 River Rd., Orange Beach, Ala. 36561

[21] Appl. No.: 428,899

[22] Filed: Oct. 30, 1989

[51] Int. Cl.[5] ..... E06C 9/08

[52] U.S. Cl. ..... 182/85; 182/207

[58] Field of Search ..... 182/85, 84, 83, 228, 182/207

[56] References Cited

U.S. PATENT DOCUMENTS

| | | | |
|---|---|---|---|
| 1,087,434 | 2/1914 | Bone | 182/85 |
| 1,314,769 | 9/1919 | Toth | 182/93 |
| 1,482,883 | 2/1924 | Bulger | 182/85 |
| 1,808,492 | 6/1931 | Bocchino | 182/85 |
| 2,805,104 | 9/1957 | Johnson | 182/120 |
| 2,860,822 | 11/1958 | Smith | 182/93 |
| 4,067,412 | 1/1978 | Jackson | 182/85 |

*Primary Examiner*—Reinaldo P. Machado
*Attorney, Agent, or Firm*—Nies, Kurz, Bergert & Tamburro

[57] ABSTRACT

A ladder assembly for ease of access to a wharf or pier is disclosed. The ladder assembly includes a pair of vertical frame members having channels therein which are disposed about a ladder which is free to move upwardly and downwardly within the channels. The ladder may be secured to a cleat on the pier in a raised position when not in use. Upon releasing the ladder from the cleat, the ladder will move downwardly under its own weight so that its lower portion enters the water. A plate member attached to the top rung of the ladder will engage the deck surface of the pier in the lowermost position of the ladder.

6 Claims, 2 Drawing Sheets

LADDER ASSEMBLY

BACKGROUND AND SUMMARY OF THE INVENTION

The present invention relates to a ladder assembly which can be permanently attached to a wharf or pier. More particularly, the present invention relates to a ladder for use on a wharf or pier, wherein the ladder may be secured by a rope so as to be pulled up when not in use and will fall into the water on its own weight when the rope is untied.

Previous ladder constructions are described in the following U.S. Pat. Nos.: 519,184 to Holbrook; 1,314,769 to Toth; 2,860,822 to Smith et al.; 4,067,412 to Jackson; and 4,139,078 to Keller.

By the present invention, there is provided an improved ladder assembly which is easily constructed and installed on a wharf or pier to facilitate access to and from the pier, either from the water or a boat moored to the pier. The ladder assembly of the invention includes a pair of vertical frame members having channels therein which are disposed about a ladder which is free to move upwardly and downwardly within the channels. The ladder may be secured to a cleat on the pier in a raised position when not in use. Upon releasing the ladder from the cleat, the ladder will move downwardly under its own weight so that its lower portion enters the water. A flat plate member is mounted on an upper rung of the ladder to serve as a stop in both the upper and lower positions of the ladder.

DESCRIPTION OF THE PREFERRED EMBODIMENTS

Figure 1:
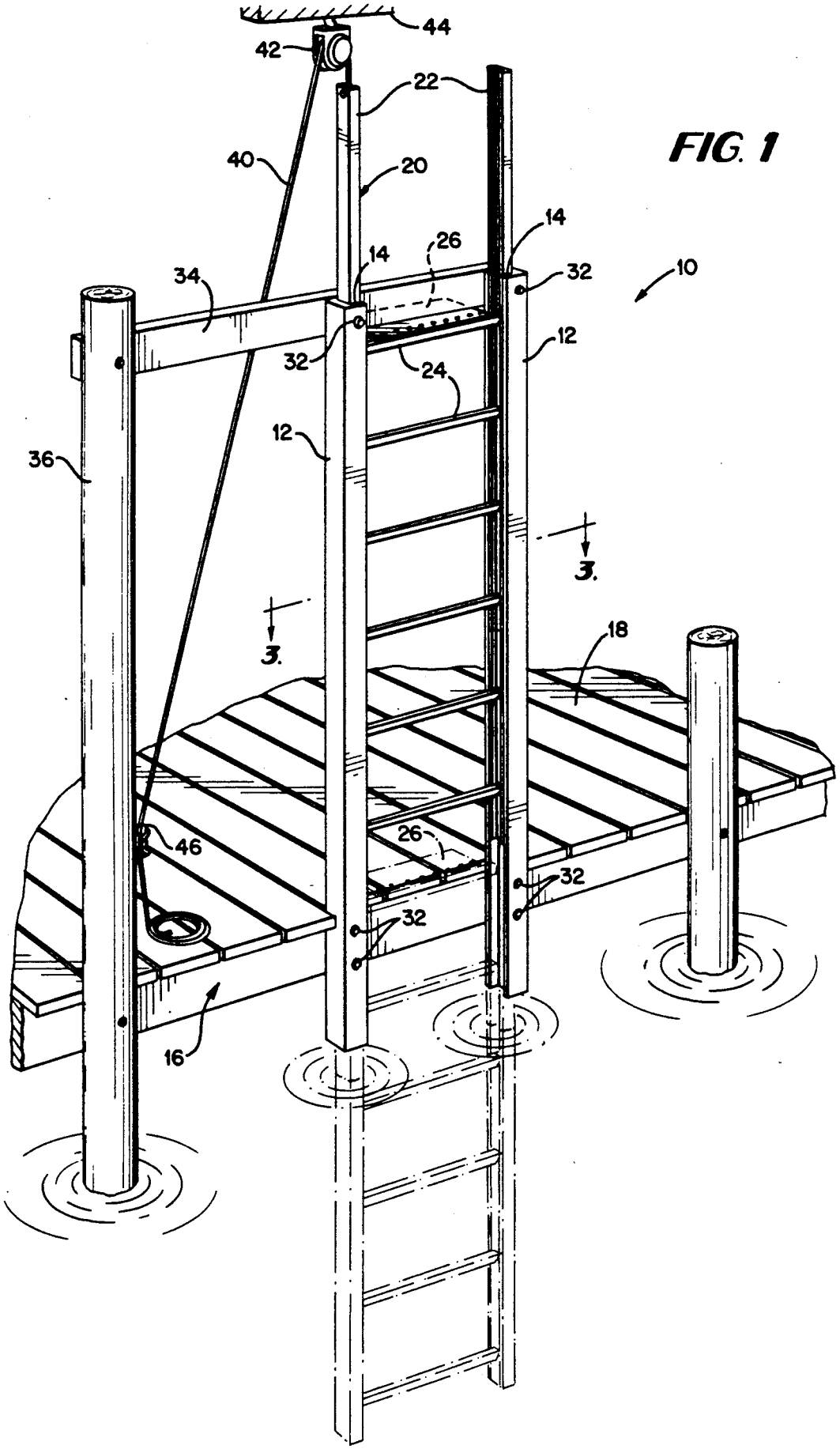
FIG. 1 is a perspective view of a ladder assembly of the present invention as installed on a wharf or pier.
Figure 2:
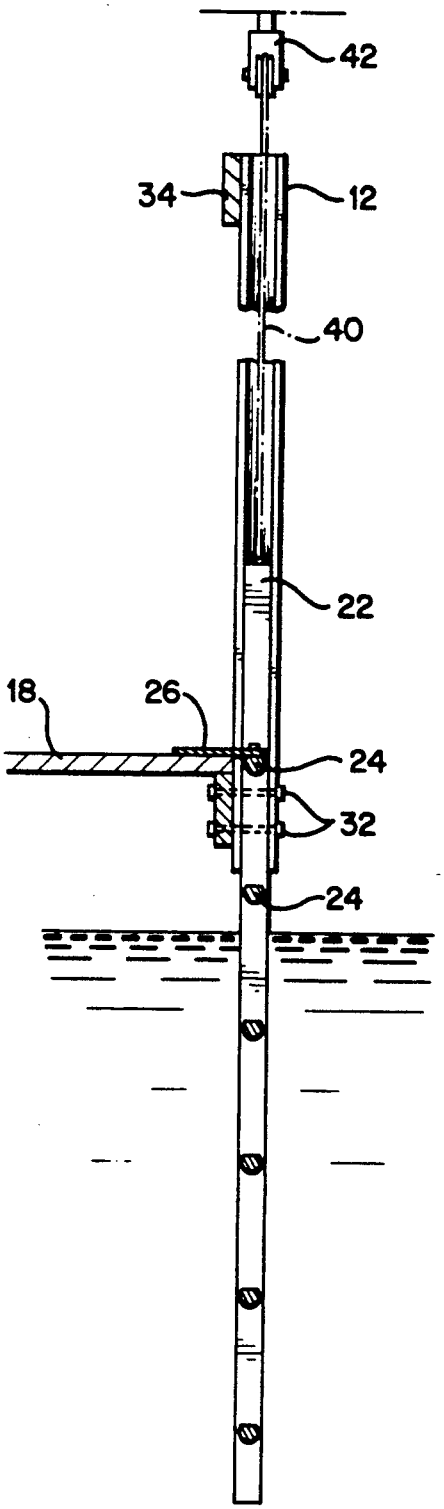
FIG. 2 is a vertical cross sectional view of the ladder assembly of FIG. 1.
Figure 3:
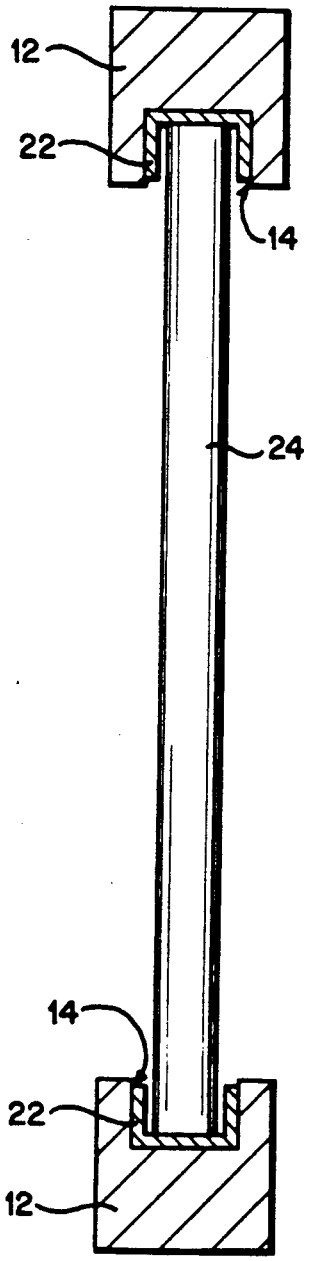
FIG. 3 is a horizontal cross sectional view taken along line 3—3 of FIG. 1.

In the embodiment of the invention as shown in FIGS. 1 through 3, there is provided a ladder assembly 10 which includes a pair of spaced parallel vertical elongated frame members 12 provided on the inwardly facing sides thereof with a pair of vertical channels 14 and with members 12 bolted vertically to a pier 16. A ladder member 20 formed of a pair of parallel vertical members 22 joined by horizontal rungs 24 is mounted in the channels 14 so as to move freely upwardly and downwardly therein. In one embodiment, members 12 are formed of a pair of treated 4×4's that have been routed out to form the channels 14.

A flat plate 26 of a material such as aluminum is attached in a horizontal position to the top rung 24 of the ladder 20. The plate member 26 supports the ladder 20 when a person is using the ladder to get in and out of the water.

As shown in FIG. 1, at their lower ends the frame members 12 are bolted to the pier 16 by bolts 32. At their upper ends the frame members 12 are bolted to a horizonal member 34 which is secured to a vertical piling member 36 of the pier 16.

A rope 40 is attached at one end to the upper end of the ladder 20 and extends through a pulley 42 mounted on a roof member 44 of an overhanging roof over the pier 16. A cleat 46 is mounted on the pier 16 for receiving the other end of the rope 40.

The ladder 20 may be formed of a material such as aluminum having sufficient weight and density so that the ladder 20 will fall into the water when the rope 40 is released from the cleat 46, no matter what the water level may be, with the ladder 20 moving downwardly until plate 26 makes contact with the deck 18 of the pier 16 as shown in FIG. 1. Once the ladder 20 has attained this lower position, it may then be utilized for easy access to and from the water or a boat moored adjacent the pier 16. It will be understood that the plate member 26 should be attached to the upper rung 24 rather than a lower rung of the ladder 20, otherwise it would be necessary to climb over any upper rungs above the plate 26 in order to gain access to the deck 18 of the pier.

The upper horizontal member 34 acts as a stop for plate member 26 when the ladder 20 is moved to the upper position and member 34 also supports the top end of vertical frame members 12. When it is not feasible to provide a horizontal member 34, the ladder may be raised to the desired height by use of the rope 40 and the rope 40 is then secured to the cleat 46 to maintain the ladder at such height.

From the foregoing description, it can be seen that the ladder 20 can be pulled up by the rope attachment 40 when not in use and will fall into the water on its own weight as it is untied from the cleat 46 holding the rope.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A ladder assembly for attachment to a wharf or pier comprising:

a pair of elongated frame members, each frame member having a channel extending the length of the frame member;

a ladder member mounted in said channels for movement along the length of said frame members, said ladder member including a pair of vertical side members interconnected by a plurality of rungs; and a flat plate member attached to and extending from one of said rungs in a plane generally perpendicular to said side members, said ladder member being mounted in said channels for free movement along the length of said channels, and with said ladder member being of a material having sufficient weight and density so that said ladder member will fall into the water surrounding said wharf or pier until said plate member contacts said wharf or pier.

2. The ladder assembly of claim 1 further including a support having at least one post member for attachment to said wharf or pier and a bracket secured to and extending from the post member and being attached to the upper end of said frame members, said bracket acting as a stop to prevent upward movement of said plate member.

3. The ladder assembly of claim 1 further including a rope and pulley assembly wherein said rope is attached to said ladder member and said pulley is attachable to said wharf or pier in a position to receive said rope.

4. The ladder assembly of claim 3 further including a cleat member for attachment to said wharf or pier for the purpose of receiving said rope so as to secure said ladder member in a fixed position.

5. The ladder assembly of claim 1 wherein said ladder member has a top rung one end of said ladder and wherein said plate member is attached to said top rung.

6. A ladder assembly for attachment to a wharf or pier comprising:

a pair of elongated frame members, each frame member having a channel extending the length of the frame member;

a ladder member mounted in said channels for movement along the length of said frame members, said ladder member including a pair of vertical side members interconnected by a plurality of rungs;

a flat plate member attached to and extending from one of said rungs in a plane generally perpendicular to said side members; and a support having at least one post member for attachment to said wharf or pier and a bracket secured to and extending from the post member and being attached to the upper end of said frame members, said bracket acting as a stop to prevent upward movement of said plate member.

* * * * *